US010487830B2

(12) United States Patent
Mizufune et al.

(10) Patent No.: US 10,487,830 B2
(45) Date of Patent: Nov. 26, 2019

(54) AIR COMPRESSION DEVICE TO PREVENT BACKFLOW OF COMPRESSED AIR TOWARD COMPRESSOR AFTER THE COMPRESSOR IS STOPPED

(71) Applicant: NABTESCO CORPORATION, Tokyo (JP)

(72) Inventors: Toru Mizufune, Hyogo (JP); Masaru Kuromitsu, Hyogo (JP); Tatsuo Miyauchi, Hyogo (JP)

(73) Assignee: NABTESCO CORPORATION, Tokyo (JP)

( * ) Notice: Subject to any disclaimer, the term of this patent is extended or adjusted under 35 U.S.C. 154(b) by 157 days.

(21) Appl. No.: 14/748,801

(22) Filed: Jun. 24, 2015

(65) Prior Publication Data

US 2016/0003246 A1 Jan. 7, 2016

(30) Foreign Application Priority Data

Jul. 3, 2014 (JP) ..... 2014-138111

(51) Int. Cl.
*F04C 28/24* (2006.01)
*F04C 28/28* (2006.01)
*F04C 29/00* (2006.01)

(52) U.S. Cl.
CPC ..... *F04C 28/24* (2013.01); *F04C 28/28* (2013.01); *F04C 29/0028* (2013.01)

(58) Field of Classification Search
CPC ..... F04D 27/009; F04D 25/08; F04B 49/22; F04B 49/03; F04C 28/24; F04C 28/28; F04C 29/0028
See application file for complete search history.

(56) References Cited

U.S. PATENT DOCUMENTS 1,786,114 A 12/1930 Hughes
2,921,732 A 1/1960 De Vin
3,788,769 A 1/1974 Glass et al.
(Continued)

FOREIGN PATENT DOCUMENTS

CN 1987107 A 6/2007
CN 102086856 A 6/2011
(Continued)

OTHER PUBLICATIONS

Extended European Search Report as issued in European Patent Application No. 15173956.2, dated Nov. 4, 2015.
(Continued)

*Primary Examiner* — Bryan M Lettman
(74) *Attorney, Agent, or Firm* — Pillsbury Winthrop Shaw Pittman, LLP

(57) ABSTRACT

An air compression device includes a rotary compressor, a discharge flow channel, a release flow channel and an operation control unit. The discharge flow channel is connected to a discharge portion of the rotary compressor. The release flow channel is disposed to be connectable to the discharge flow channel. The operation control unit is configured to perform a release operation of releasing a part or all of compressed air remaining in the discharge flow channel through the release flow channel when the operation control unit controls to stop the rotary compressor.

6 Claims, 3 Drawing Sheets

(56) References Cited

U.S. PATENT DOCUMENTS

| | | | | |
|---|---|---|---|---|
| 5,713,724 | A * | 2/1998 | Centers | F04B 49/065 417/279 |
| 2006/0018769 | A1 * | 1/2006 | Van Praag | F04B 49/225 417/410.4 |
| 2007/0140866 | A1 | 6/2007 | Tanaka | |
| 2010/0047646 | A1 | 2/2010 | Kitamura | |
| 2011/0129361 | A1 | 6/2011 | Sato | |

FOREIGN PATENT DOCUMENTS

| | | | |
|---|---|---|---|
| CN | 201954863 | U | 8/2011 |
| JP | S52-010908 | A | 1/1977 |
| JP | H11-201039 | A | 7/1999 |
| JP | 2013-007285 | A | 1/2013 |
| WO | 2008/007689 | A1 | 1/2008 |

OTHER PUBLICATIONS

Office Action as issued in Chinese Patent Application No. 201510388239.5, dated Jul. 22, 2016.

Office Action as issued in Chinese Patent Application No. 201510388239.5, dated Mar. 21, 2017.

Notification of Reasons for Refusal Japanese Patent Application No. 2014-138111 dated May 8, 2018 with English translation.

Notification of Reasons for Refusal dated Jan. 8, 2019 issued in corresponding Japanese Patent Application No. 2014-138111 with English translation.

* cited by examiner

AIR COMPRESSION DEVICE TO PREVENT BACKFLOW OF COMPRESSED AIR TOWARD COMPRESSOR AFTER THE COMPRESSOR IS STOPPED

TECHNICAL FIELD

The present invention relates to an air compression device for use in driving a device such as a vehicle brake device or a door opening/closing device.

BACKGROUND ART

Conventionally, high pressure air (compressed air) obtained by compression in an air compression device is used for driving a device such as a vehicle brake device or a door opening/closing device. FIG. 1 and FIG. 4 of Japanese Unexamined Patent Publication No. H11-201039 (hereinafter, called as Patent Literature 1) discloses an air compression device to be loaded in a railway vehicle. In the air compression device illustrated in FIG. 4 of Patent Literature 1, the air which is brought to a high temperature state by compression in a compressor is cooled by an after cooler (a cooler). The cooled compressed air is dehumidified in a dehumidifier. The dehumidified compressed air is stored in an air tank. The compressed air stored in the air tank is supplied to the aforementioned device.

The following problem may occur when a rotary compressor such as a scroll compressor is used as a compressor in the aforementioned conventional air compression device. Specifically, compressed air remains between the compressor and the dehumidifier after the scroll compressor is stopped. As a result, when the scroll compressor is stopped, the remaining compressed air flows back toward the compressor, and may rotate a scroll (a rotary piston) in the backward direction. The number of backward rotations may gradually increase, and may reach as high as about 3,000 rpm. Sound generated in this case may vary, as the rotation number changes. Therefore, it is necessary to prevent generation of such abnormal sound. Further, when the number of backward rotations exceeds an allowable rotation speed of the compressor, the durability of the scroll may be adversely affected.

In order to prevent the drawbacks resulting from backflow as described above, there is proposed an idea of providing a check valve at a position near the compressor on the discharge side of the compressor. For instance, in the air compression device disclosed in Patent Literature 1, a check valve is provided on the suction side of the compressor. It is possible to provide a check valve in a discharge flow channel of a compressor, specifically, in a flow channel between the compressor and the after cooler. However, the temperature of the air to be discharged from the compressor may reach as high as around 200° C. Therefore, when a check valve is provided as described above, it is necessary to use an expensive high temperature oriented member such as a seal member for the check valve. Thus, there is room for improvement regarding the maintenance cost.

Further, in the air compression device illustrated in FIG. 1 of Patent Literature 1, a check valve is disposed in a suction flow channel connected to a suction port of the compressor as described above. However, the suction flow channel is in a low pressure state. Therefore, even if a check valve is provided in the suction flow channel, backflow of compressed air in a high temperature state cannot be completely prevented. Thus, it is difficult to completely prevent backflow of compressed air toward the compressor.

SUMMARY OF INVENTION

An object of the invention is to provide an air compression device provided with a rotary compressor which enables to prevent backflow of compressed air toward the compressor after the compressor is stopped, and to prevent the drawbacks resulting from backflow, without providing an expensive high temperature oriented check valve.

An air compression device according to an aspect of the invention is provided with a rotary compressor; a discharge flow channel connected to a discharge portion of the compressor; a release flow channel disposed to be connectable to the discharge flow channel; and an operation control unit configured to perform a release operation of releasing a part or all of compressed air remaining in the discharge flow channel through the release flow channel when the operation control unit controls to stop the compressor.

These and other objects, features and advantages of the present invention will become more apparent upon reading the following detailed description along with the accompanying drawings.

DESCRIPTION OF EMBODIMENT

Figure 1:
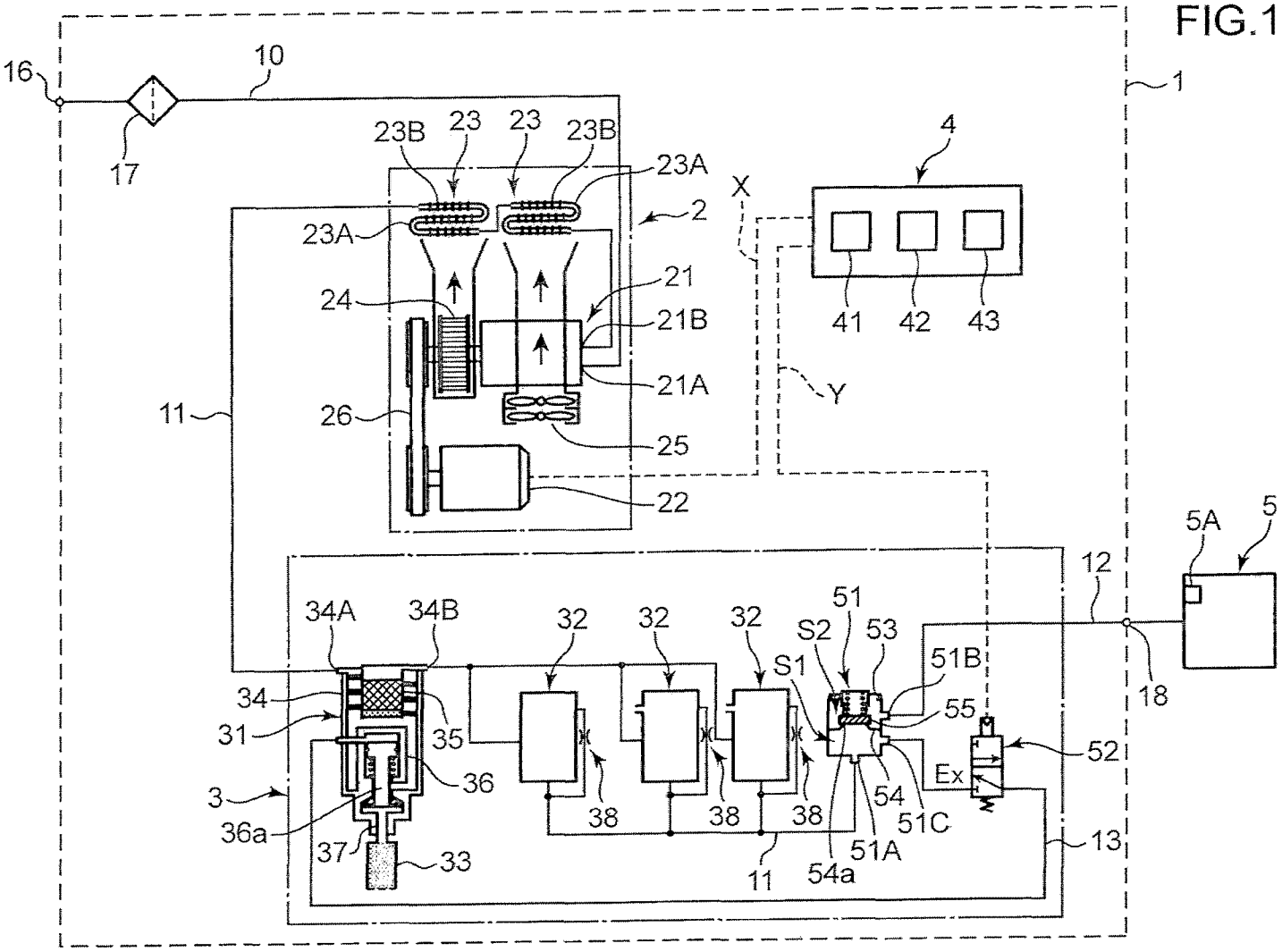
FIG. 1 is a schematic configuration diagram illustrating an air compression device in an embodiment of the invention.

In the following, an air compression device 1 in an embodiment of the invention is described referring to the drawings. The air compression device 1 in the embodiment illustrated in FIG. 1 is configured to generate compressed air. The air compression device 1 is provided in a railway vehicle, for instance. The compressed air generated in the air compression device 1 is used for driving a device such as a railway vehicle brake device or a door opening/closing device. The use of the air compression device 1 is not limited for a railway vehicle. The air compression device 1 may be used for a vehicle other than a railway vehicle, or may be used for a purpose other than a vehicle.

[Structure of Air Compression Device]

As illustrated in FIG. 1, the air compression device 1 is provided with an electrically-driven air compression mechanism 2, a dehumidifying mechanism 3, and a controller 4. The air sucked through a suction port 16 of the air compression device 1 passes through an air filter (an air filtration member 17), and flows into the electrically-driven air compression mechanism 2. The air is compressed in the electrically-driven air compression mechanism 2. The compressed air generated in the electrically-driven air compression mechanism 2 is dehumidified in the dehumidifying mechanism 3. The compressed air dehumidified in the dehumidifying mechanism 3 flows through a discharge port 18 of the air compression device 1, and is stored in an air tank 5 (a pressure tank). The compressed air stored in the air tank 5 is supplied to the aforementioned device, as necessary.

In the air compression device 1 in the embodiment, an ordinary operation of generating compressed air and storing the compressed air in the air tank 5, and a release operation of releasing a part or all of the compressed air in the air compression device 1 to the outside are performed. This configuration makes it possible to prevent the drawbacks such as generation of abnormal sound resulting from backflow of compressed air after an ordinary operation is finished. In the following, an exemplified configuration of the embodiment is described. The air compression device 1 in the embodiment is not limited to the following example.

As illustrated in FIG. 1, the air compression device 1 is provided with a suction flow channel 10 for connecting between the suction port 16 and the electrically-driven air compression mechanism 2, a discharge flow channel 11 for connecting between the electrically-driven air compression mechanism 2 and a check valve 51 to be described later, a downstream flow channel 12 for connecting between the check valve 51 and the discharge port 18, and a release flow channel 13 for releasing the compressed air.

In the embodiment, the electrically-driven air compression mechanism 2 is provided with a rotary compressor 21, an electric motor 22, coolers 23, and fans 24 and 25. Further, in the embodiment, the dehumidifying mechanism 3 is provided with a drain separator 31 as a first dehumidifier, second dehumidifiers 32, the check valve 51, and an electromagnetic valve 52 as an opening/closing mechanism. In the embodiment, the check valve 51 and the electromagnetic valve 52 (an opening/closing mechanism) are provided as a part of the dehumidifying mechanism 3. The embodiment is not limited to the above.

The compressor 21 is a scroll compressor. Specifically, the compressor 21 is provided with a fixed scroll (a first spiral member), a turning scroll as a rotary piston (a second spiral member), and a housing for housing the fixed scroll and the turning scroll. The fixed scroll and the turning scroll are configured to engage with each other. A compression space is defined in the housing by these members. The scroll compressor 21 causes the turning scroll to turn in the forward direction with respect to the fixed scroll fixedly mounted in the housing so as to gradually reduce the volume of the compression space and to generate compressed air. In the scroll compressor 21 having the aforementioned configuration, when backward rotation whose direction is opposite to the direction of forward rotation for generating compressed air is performed, abnormal sound is likely to occur.

A suction port 21A and a discharge port 21B are formed in the housing. The suction port 21A is connected to one end of the suction flow channel 10, and the discharge port 21B is connected to one end of the discharge flow channel 11. The air sucked into the housing through the suction port 21A flows into the compression space, and the air is gradually pressurized, as the turning scroll turns. Thus, the pressurized compressed air flows to the discharge flow channel 11 through the discharge port 21B.

The electric motor (a motor) 22 is provided as a driving mechanism for driving the compressor 21. The electric motor 22 is configured to operate based on a start signal from the controller 4. In the embodiment, a rotating shaft of the electric motor 22 is coupled to a rotating shaft of the compressor 21 via a coupling member 26 such as a belt. The embodiment is not limited to the above. For instance, the rotating shaft of the electric motor 22 may be directly connected to the rotating shaft of the compressor 21.

The coolers 23 are provided as a heat exchanger for cooling the compressed air, in which compression heat by compression in the compressor 21 remains. In the example illustrated in FIG. 1, the coolers 23 are plate fin tube coolers. Alternatively, the coolers may be of any type other than the above. Each of the plate fin tube coolers 23 is provided with a tube 23A through which compressed air flows and a plurality of fins 23B aligned along the tube 23A.

The fans 24 and 25 are provided to form a flow of air (external air) directing toward the coolers 23. The coolers 23 are cooled from the outside by cooling air generated by the fans 24 and 25. As a result, the compressed air flowing through the coolers 23 is cooled. In the embodiment, two fans 24 and 25 (a first fan 24 and a second fan 25) are provided. Alternatively, only one fan may be provided. In the embodiment, the first fan 24 is configured to rotate, as the rotating shaft of the compressor 21 is rotated. The embodiment is not limited to the above. In the example illustrated in FIG. 1, the first fan 24 is a sirocco fan, and the second fan 25 is a propeller fan. Alternatively, fans of the other types may be used.

The drain separator 31 is disposed in the discharge flow channel 11 at a position downstream of the coolers 23. The drain separator 31 is provided with a filter 35 for separating water and oil from the compressed air that has been cooled in the coolers 23. Specifically, the drain separator 31 is provided with a case 34. The filter 35 and a drain valve 36 for discharging the drain are provided in the case 34. Further, the case 34 is formed with an inlet port 34A through which the compressed air supplied from the compressor 21 flows in, and an outlet port 34B through which the compressed air that has passed through the drain separator 31 flows out toward the discharge flow channel 11 at a position downstream of the drain separator 31.

The drain valve 36 is kept in a close state when an ordinary operation of generating compressed air is performed. When the drain valve 36 is opened, the drain including water and oil is discharged to the outside together with the compressed air through a discharge pipe 37 adjacent to the drain valve 36. Further, the discharge pipe 37 is provided with a silencer 33 for reducing the noise, which may be generated accompanied by discharge of the drain.

The opening/closing mechanism of the drain valve 36 is not specifically limited. The opening/closing mechanism of the drain valve 36 may be a mechanism for opening and closing the discharge passage in the drain valve 36 continuing with the release flow channel 13 by causing a valve member 36*a* to slide resulting from an operation of the electromagnetic valve 52. For instance, when the electromagnetic valve 52 is brought to an open state in response to a start signal from the controller 4, the valve member 36*a* of the drain valve 36 is pressed by the air in the discharge passage against the compressed air in the discharge flow channel 11 of the dehumidifying mechanism 3, whereby the drain valve 36 is brought to an open state. This makes it possible to release the compressed air remaining in the discharge flow channel 11, the coolers 23, the drain separator 31 and the second dehumidifiers 32. The valve member 36*a* of the drain valve 36 may be such that a tapered surface is formed on an end of the valve member 36*a*, as illustrated in FIG. 1. The drain valve 36 is opened and closed by causing the valve member 36*a* to slide in the axis direction of the valve member 36*a*.

The second dehumidifiers 32 are provided in the discharge flow channel 11 at a position downstream of the drain separator 31. The second dehumidifiers 32 are provided to dehumidify the compressed air after water and oil are separated from the compressed air in the drain separator 31. An example of the second dehumidifiers 32 is a hollow fiber membrane dehumidifier. Alternatively, the second dehumidifiers 32 may be dehumidifiers for dehumidifying using a drying agent. In the embodiment illustrated in FIG. 1, a plurality of dehumidifier (three dehumidifiers) 32 is provided. Alternatively, a single second dehumidifier 32 may be provided. In each of the second dehumidifiers 32, there is provided a purge diaphragm 38 for reducing the passing amount of purge gas that allows for a part of dehumidified air generated in the second dehumidifier 32 to flow back to the second dehumidifier 32.

The check valve 51 is provided downstream of the second dehumidifiers 32, and connects between the discharge flow channel 11 and the downstream flow channel 12. The check valve 51 allows for the compressed air of an pressure exceeding a predetermined pressure to pass and flow toward the discharge port 18 (toward the air tank 5). The check valve 51 prevents backflow of the compressed air, which is dehumidified while passing through the drain separator 31 and the second dehumidifiers 32, toward the drain separator 31 and the second dehumidifiers 32. Specifically, the check valve 51 prevents backflow of compressed air from the downstream flow channel 12 and from the air tank 5 toward the discharge flow channel 11 disposed upstream of the check valve 51.

In the embodiment illustrated in FIG. 1, the check valve 51 is provided with a case 53, a partition wall 54 for separating the space in the case 53 into a first space S1 and a second space S2, and a valve member 55. An opening 54*a* for communicating between the first space S1 and the second space S2 is formed in the partition wall 54. The valve member 55 is disposed in the second space S2, and blocks the opening 54*a* from the second space S2 side. The valve member 55 is urged in a direction for blocking the opening 54*a* by urging means such as a spring. The check valve 51 allows for the air to move from the first space S1 to the second space S2, and prevents the air from flowing from the second space S2 to the first space S1.

The check valve 51 includes an inlet port 51A formed in a portion of the case 53 on the first space S1 side, and an outlet port 51B formed in a portion of the case 53 on the second space S2 side. The downstream end of the discharge flow channel 11 is connected to the inlet port 51A, and the upstream end of the downstream flow channel 12 is connected to the outlet port 51B.

Further, in the embodiment, a return port 51C is formed in the portion of the case 53 on the first space S1 side. The return port 51C is connected to an end (an upstream end) of the release flow channel 13 for releasing a part or all of the compressed air remaining in the discharge flow channel 11, the coolers 23, and the dehumidifiers 31 and 32.

The electromagnetic valve 52 (the opening/closing mechanism 52) is provided in the release flow channel 13. The electromagnetic valve 52 is configured to open and close the release flow channel 13 in response to a signal from the controller 4. Specifically, the electromagnetic valve 52 has a function of connecting or disconnecting the discharge flow channel 11 to or from the release flow channel 13. The controller 4 is configured to output a signal so as to bring the electromagnetic valve 52 to a close state when an ordinary operation is performed. In this configuration, when an ordinary operation is performed, the release flow channel 13 is closed. This allows for the compressed air generated in the electrically-driven air compression mechanism 2 and flowing through the discharge flow channel 11 to flow into the downstream flow channel 12 through the check valve 51, and to be stored in the air tank 5.

On the other hand, the controller 4 is configured to output a signal so as to bring the electromagnetic valve 52 to an open state when a release operation is performed. In this configuration, when a release operation is performed, the release flow channel 13 is opened. This allows for a part or all of the compressed air remaining in the discharge flow channel 11, the coolers 23, and the dehumidifiers 31 and 32 to flow into the release flow channel 13 through the inlet port 51A and through the return port 51C, and to be released to the outside. Further, when a release operation is performed, the air pressure in the first space S1 of the check valve 51 falls below the predetermined pressure. This causes the valve member 55 to block the opening 54*a*, and prevents the compressed air from flowing from the discharge flow channel 11 toward the downstream flow channel 12 (toward the air tank 5).

In the embodiment, the air is released to the outside through the other end (the downstream end) of the release flow channel 13 via a large-capacity discharge mechanism having a capacity (a discharge capacity) larger than the capacity of the compressor 21 when a release operation is performed. In the embodiment illustrated in FIG. 1, the drain valve 36 of the drain separator 31 is used as the large-capacity discharge mechanism. Specifically, assuming that the capacity of the compressor 21 is 500 L/min when a release operation is performed, a drain valve 36 whose discharge capacity is 1,000 L/min may be used. The embodiment is not limited to the aforementioned numerical values. Any numerical value may be set, as far as the discharge capacity of air to be released to the outside from the discharge mechanism such as the drain valve 36 is larger than the capacity of compressed air to be supplied from the compressor 21 to the discharge flow channel 11 when a release operation is performed. However, increasing a difference between the discharge capacity (the amount of air to be released) of the drain valve 36 and the capacity of the compressor 21 (the amount of compressed air to be discharged) when a release operation is performed makes it possible to reduce the air pressure in the discharge flow channel 11, the coolers 23, and the dehumidifiers 31 and 32 as fast as possible. This configuration is advantageous in shortening a time duration (a delay time) from the time when the large-capacity discharge mechanism (the drain valve 36 in the embodiment) is brought to an open state until the electric motor 22 for the compressor 21 is stopped.

Further, in the embodiment, the other end (the downstream end) of the release flow channel 13 is connected to an upstream portion of the silencer 33. In this configuration, the compressed air to be released during a release operation is allowed to be released to the outside through the silencer 33. This is advantageous in reducing the noise when the compressed air is released during a release operation. More specifically, the other end (the downstream end) of the release flow channel 13 is connected to the case 34 of the drain separator 31. The compressed air flowing through the release flow channel 13 reaches the silencer 33 through the passage in the case 34. Thereafter, the compressed air is released to the outside through the silencer 33. In other words, in the embodiment, the silencer 33 is used both for discharging the drain, and for releasing the compressed air that has passed through the release flow channel 13. The invention is not limited to the above. Alternatively, a silencer other than the silencer 33 for the drain separator 31 may be used for releasing the compressed air that has passed through the release flow channel 13. Further alternatively, the compressed air that has passed through the release flow channel 13 may be directly released to the outside without passing through a silencer.

The controller 4 is constituted of a processor such as a CPU (not illustrated), a storage unit 42 such as a memory device, and an interface circuit, for instance. The controller 4 is configured to transmit and receive a signal to and from a master controller (not illustrated). The controller 4 functionally includes an operation control unit 41 which controls an operation of the air compression device 1. The operation control unit 41 controls the compressor 21 to operate and stop by controlling an operation of the electric motor 22, and controls the opening/closing mechanism (the electromagnetic valve 52 in the embodiment) to open and close in accordance with a predetermined sequence. Further, the controller 4 is provided with a timer 43 for measuring a time when a release operation is performed.

[Operation of Air Compression Device]

Figure 2:
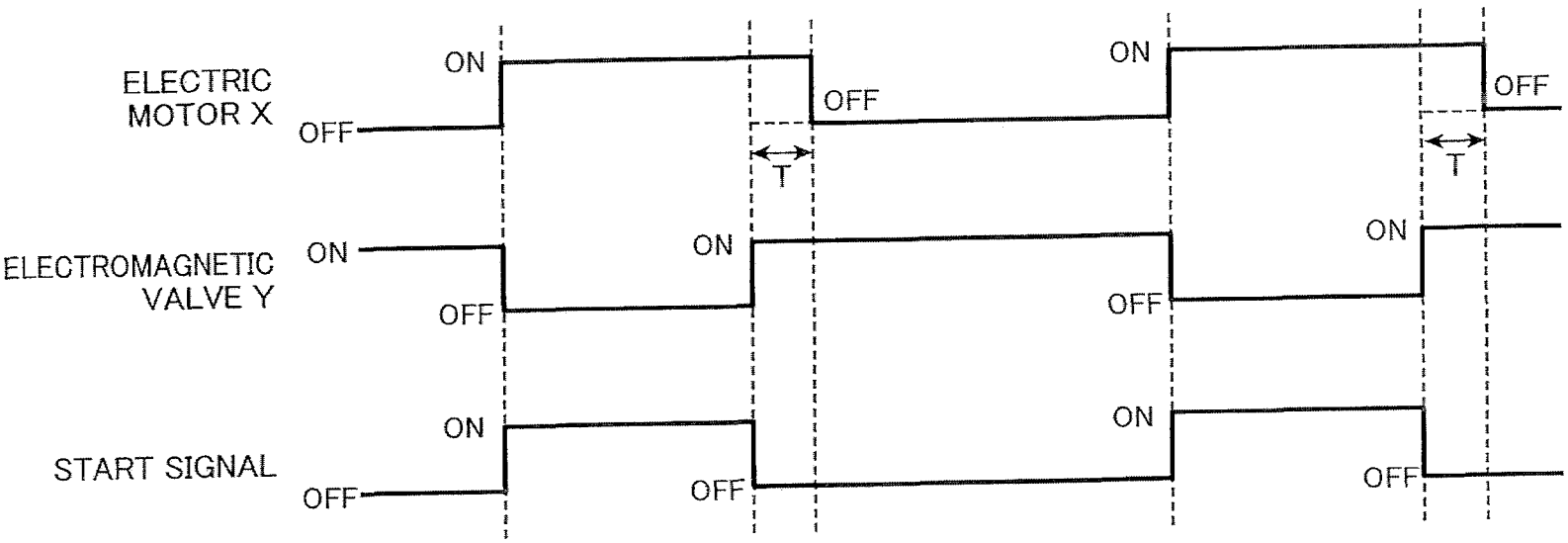
FIG. 2 is a timing chart illustrating an example of control of an ordinary operation and of a release operation to be performed by the air compression device in the embodiment.
Figure 3:
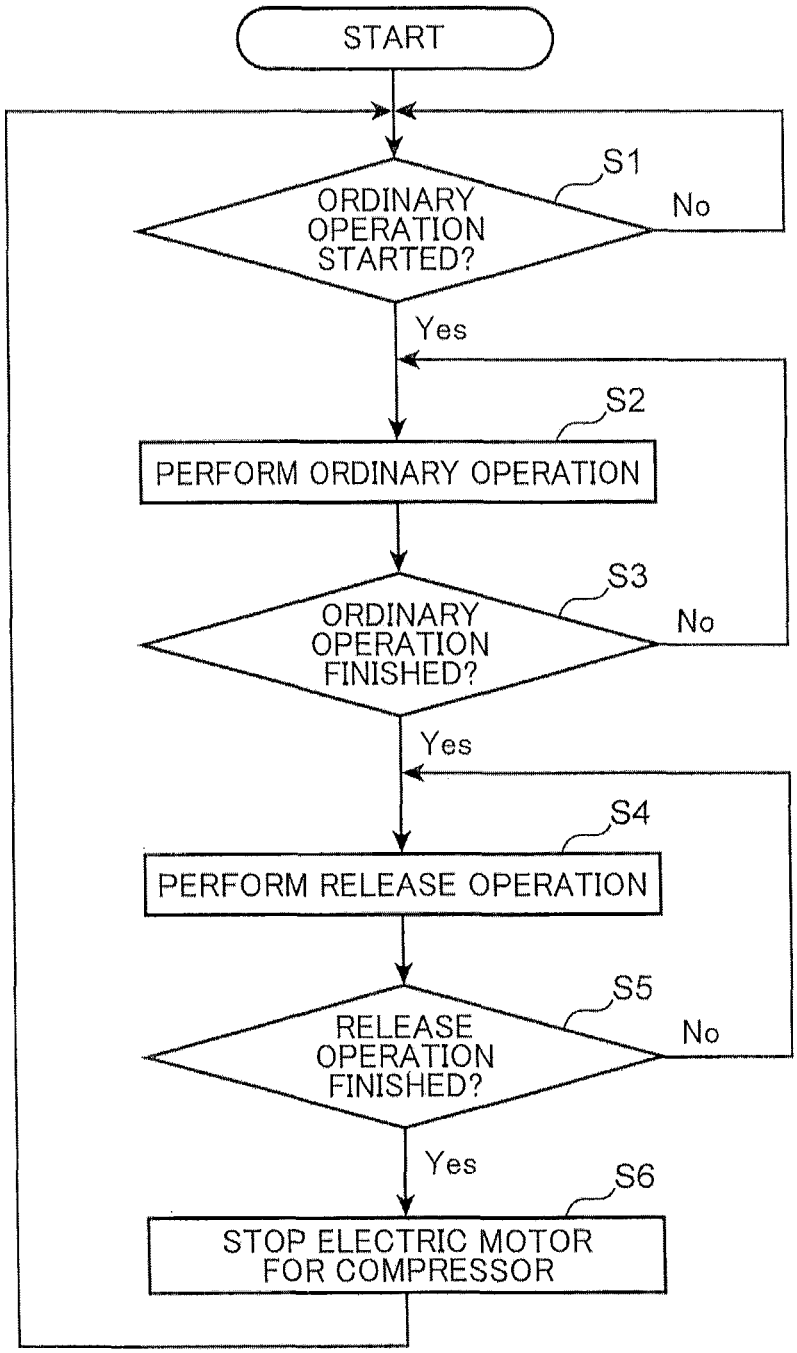
FIG. 3 is a flowchart illustrating an example of control to be performed by the air compression device in the embodiment.

In this section, an operation to be performed by the air compression device 1 is described. In the air compression device 1 in the embodiment, the operation control unit 41 controls the electric motor 22 for driving the compressor 21, and the opening/closing mechanism (the electromagnetic valve 52 in the embodiment) for opening and closing the release flow channel 13 so as to perform an ordinary operation of generating compressed air and storing the compressed air in the air tank 5, and a release operation of releasing the compressed air. When the electric motor 22 is stopped, the operation control unit 41 performs a release operation of releasing a part or all of the compressed air remaining in the discharge flow channel 11. Specifically, in response to output of a signal (an OFF signal) for stopping the electric motor 22 from the controller 4, a release operation of releasing a part or all of the compressed air remaining in the discharge flow channel 11 is performed. In the following, an example of control to be performed by the air compression device 1 in the embodiment is described in detail referring to FIG. 2 and FIG. 3. The control example illustrated in FIG. 2 and FIG. 3 is merely an example. The embodiment is not limited to the exemplified control.

FIG. 2 is a timing chart illustrating an example of control of an ordinary operation and of a release operation to be performed by the air compression device 1 in the embodiment. In the control example illustrated in FIG. 2, respective operations of the electric motor 22 and of the electromagnetic valve 52 to be controlled are controlled by a start signal to be output from the controller 4. For instance, the electric motor 22 is controlled based on a start signal transmitted from the controller 4 though a signal line X. The electromagnetic valve 52 is controlled based on a start signal transmitted from the controller 4 through a signal line Y. Specifically, in response to input of a start signal to a contactor circuit (not illustrated) or to a relay circuit (not illustrated) through the signal line X, supply and stop of electric power from an unillustrated AC power source are performed, whereby the operation and stop of the electric motor 22 are controlled.

FIG. 3 is a flowchart illustrating an example of control to be performed by the air compression device 1 in the embodiment. As illustrated in FIG. 3, the operation control unit 41 determines whether an ordinary operation is performed (Step S1). When it is determined that a condition for starting an ordinary operation is satisfied (YES in Step S1), the operation control unit 41 controls to start an ordinary operation. On the other hand, when it is determined that the condition for starting an ordinary operation is not satisfied (NO in Step S1), the operation control unit 41 repeats the determination of Step S1 without starting an ordinary operation.

The ordinary operation is an operation mode in which the electric motor 22 is driven to operate the compressor 21 so as to store the compressed air in the air tank 5 when it is necessary to store the compressed air in the air tank 5. More specifically, the ordinary operation is performed when a predetermined starting condition is satisfied. The condition for starting an ordinary operation is not specifically limited, as far as it is possible to determine whether it is necessary to store the compressed air in the air tank 5. However, the following example is proposed.

Specifically, the operation control unit 41 is configured to receive a signal from a pressure sensor 5A for detecting an air pressure in the air tank 5. The operation control unit 41 determines whether it is necessary to start an ordinary operation based on a signal from the pressure sensor 5A of the air tank 5. In this case, the operation control unit 41 determines that the condition for starting an ordinary operation is satisfied when a pressure value to be detected by the pressure sensor 5A (a pressure value of the air pressure in the air tank 5) is smaller than a predetermined first pressure value, and controls the electric motor 22 and the electromagnetic valve 52 to start an ordinary operation (Step S2).

When the condition for starting an ordinary operation is satisfied, as illustrated in FIG. 2, a start signal from the controller 4 is switched to an ON-state. When the start signal is switched to an ON-state, the electric motor 22 is switched to an operation state (an ON-state), and the electromagnetic valve 52 is switched to a close state (an OFF-state). Then, an ordinary operation is started.

Specifically, when an ordinary operation is performed, the electric motor 22 is operated in a state that the release flow channel 13 is brought to a close state by the electromagnetic valve 52. In other words, when an ordinary operation is performed, the compressor 21 is driven in a state that the discharge flow channel 11 and the release flow channel 13 are disconnected from each other by the electromagnetic valve 52. When the electric motor 22 is operated, compressed air is generated by the compressor 21. The generated compressed air is stored in the air tank 5 via the dehumidifying mechanism 3.

Subsequently, as illustrated in FIG. 3, the operation control unit 41 of the controller 4 determines whether the ordinary operation is finished (Step S3). When it is determined that a condition for finishing an ordinary operation is satisfied (YES in Step S3), the operation control unit 41 controls to finish the ordinary operation, and to start a release operation (Step S4). On the other hand, when it is determined that the condition for finishing an ordinary operation is not satisfied (NO in Step S3), the operation control unit 41 continues to perform an ordinary operation (Step S2).

The condition for finishing an ordinary operation is not specifically limited, as far as it is possible to determine whether compressed air of a predetermined amount is stored in the air tank 5. However, the following example is proposed. Specifically, the operation control unit 41 determines whether it is necessary to finish an ordinary operation based on a signal from the pressure sensor 5A of the air tank 5. In this case, the operation control unit 41 determines that the condition for finishing an ordinary operation is satisfied when a pressure value to be detected by the pressure sensor 5A (a pressure value of the air pressure in the air tank 5) is equal to or larger than a second pressure value higher than the first pressure value, and controls the electric motor 22 and the electromagnetic valve 52 to finish the ordinary operation (YES in Step S3).

When the condition for finishing an ordinary operation is satisfied, the operation control unit 41 controls to stop the compressor 21. Specifically, as illustrated in FIG. 2, when the operation control unit 41 controls to stop the compressor 21, a start signal from the controller 4 is switched to an OFF-state. When the start signal is switched to an OFF-state, the electric motor 22 is kept in an operation state (an ON-state), and the electromagnetic valve 52 is switched to an open state (an ON-state). Then, the ordinary operation is finished, and a release operation is started (Step S4 in FIG. 3).

Specifically, when a release operation is performed, the release flow channel 13 is kept in an open state by the electromagnetic valve 52 (a state that the discharge flow channel 11 and the release flow channel 13 are connected to each other). Therefore, a part or all of the compressed air remaining in the discharge flow channel 11, the coolers 23, and the dehumidifiers 31 and 32 flows into the release flow channel 13 through the electromagnetic valve 52, and is released to the outside via the silencer 33. When a release operation is performed, the operation of the electric motor 22 is continued. Therefore, compressed air is newly generated in the compressor 21. However, the air compression device 1 is configured such that the amount of compressed air to be released through the release flow channel 13 per unit time is larger than the amount of compressed air to be generated per unit time. Therefore, the air pressures in the discharge flow channel 11, the coolers 23, and the dehumidifiers 31 and 32 are gradually lowered.

The release operation is continued until a predetermined finishing condition is satisfied. As illustrated in FIG. 3, the operation control unit 41 determines whether the release operation is finished (Step S5). When it is determined that a condition for finishing a release operation is satisfied (YES in Step S5), the operation control unit 41 controls to finish the release operation. Specifically, the electric motor 22 is controlled to stop (Step S6). Subsequently, the operation control unit 41 determines whether it is necessary to start a next-time ordinary operation in the same manner as described above (Step S1). On the other hand, when it is determined that the condition for finishing a release operation is not satisfied (NO in Step S5), the operation control unit 41 continues the release operation (Step S4).

In the example illustrated in FIG. 2, an elapsed time from the time when a release operation is started is used as the condition for finishing a release operation. Specifically, the operation control unit 41 is configured to continue a release operation until a predetermined time T elapses. When an ordinary operation is finished and a start signal from the controller 4 is switched to an OFF-state, the timer 43 starts measuring a time. Subsequently, when the time measured by the timer 43 reaches the time T, the operation control unit 41 determines that the condition for finishing a release operation is satisfied (YES in Step S5 in FIG. 3). Subsequently, as illustrated in FIG. 2, the operation control unit 41 switches the electric motor 22 to a stop state (an OFF-state). Then, the electric motor 22 is stopped, and the release operation is finished (Step S6 in FIG. 3). The condition for finishing a release operation may be a condition other than an elapsed time.

After the release operation is finished and until a next-time ordinary operation is started, the electric motor 22 is in a stop state. Further, in the example illustrated in FIG. 2, the electromagnetic valve 52 is kept in an open state until a next-time ordinary operation is started. Alternatively, the electromagnetic valve 52 may be kept in a close state.

A drain discharge mode may be provided as a mode other than the release operation mode. In the drain discharge mode, for instance, the drain valve 36 is controlled to be opened at a predetermined time interval so as to discharge the drain during an ordinary operation.

Summary of Embodiment

In the embodiment, when the electric motor 22 is stopped, a release operation of releasing a part or all of the compressed air remaining in the discharge flow channel 11, the coolers 23, the drain separator 31 and the second dehumidifiers 32 is released to the outside is performed. This makes it possible to prevent backflow of compressed air toward the compressor 21 after the compressor 21 is stopped, regardless of the absence of a high temperature oriented check valve at a position near the compressor 21 (e.g. a flow channel between the compressor 21 and the coolers 23). This is advantageous in preventing the drawbacks such as generation of abnormal sound resulting from backflow. Thus, there is no need of providing a high temperature oriented check valve at the aforementioned position. This is advantageous in reducing the maintenance cost.

Specifically, the operation control unit 41 controls to start releasing compressed air while driving the electric motor 22, and to stop the electric motor 22 after a predetermined time T elapses when a release operation is performed. The predetermined time T is a time capable of releasing the compressed air remaining in the discharge flow channel 11, the coolers 23, the drain separator 31 and the second dehumidifiers 32 to such an extent that enables to prevent the drawbacks resulting from backflow. It is possible to determine the predetermined time T based on an experiment, simulation, or the like. Therefore, the embodiment is advantageous in securely preventing backflow of compressed air toward the compressor 21 after the compressor 21 is stopped. Further, in the embodiment, when a release operation is performed, releasing the compressed air is started while driving the electric motor 22, and the compressor 21 is continued to be operated until the compressed air remaining in the discharge flow channel 11 is released for a predetermined time T. This is also advantageous in preventing backflow of compressed air toward the compressor 21 when the compressed air is released to the outside.

More specifically, the electromagnetic valve 52 as an opening/closing mechanism is controlled to be brought to an open state at a point of time earlier than the time when the electric motor 22 is stopped by a sequencer, by a predetermined time T, so as to release the compressed air remaining in the drain separator 31 and the second dehumidifiers 32 to the outside. When a start signal (an OFF-signal) is output from the controller 4, the electromagnetic valve 52 is brought to an open state (an ON-state), and the electric motor 22 is continued to be operated during a time T measured by the timer 43. This allows for the remaining compressed air to be released to the outside.

In the embodiment, the air compression device 1 is provided with the dehumidifiers 31 and 32 disposed in the discharge flow channel 11 and configured to dehumidify the compressed air discharged from the compressor 21; the check valve 51 disposed in the discharge flow channel 11 at a position downstream of the dehumidifiers 31 and 32 and configured to prevent backflow of the compressed air that is dehumidified while passing through the dehumidifiers 31 and 32 toward the dehumidifiers 31 and 32; the release flow channel 13 configured to release a part or all of the compressed air remaining in the discharge flow channel 11 and the dehumidifiers 31 and 32; and the electromagnetic valve 52 as an opening/closing mechanism for opening and closing the release flow channel 13. In the aforementioned configuration, the compressed air remaining in the discharge flow channel 11, the coolers 23, and the dehumidifiers 31 and 32, which are disposed between the check valve 51 and the compressor 21, is released to the outside when a release operation is performed.

The operation control unit 41 is configured to bring the electromagnetic valve 52 to a close state and to operate the electric motor 22 when an ordinary operation of generating compressed air is performed, and to bring the electromagnetic valve 52 to an open state before the electric motor 22 is stopped when a release operation is performed. This allows for the operation control unit 41 to appropriately perform an ordinary operation and a release operation by controlling the timing of operating the compressor 21 and the timing of stopping the compressor 21 in association with the operations of opening and closing the electromagnetic valve 52.

In the embodiment, the air compression device is provided with the silencer 33 which the compressed air to be released passes through when a release operation is performed. This makes it possible to reduce the noise when the compressed air is released during a release operation.

MODIFICATIONS

An embodiment of the invention is described as above. The invention is not limited to the embodiment, and various modifications and improvements are applicable as far as such modifications and improvements do not depart from the gist of the invention.

In the embodiment, the air compression device 1 is provided with one electrically-driven air compression mechanism 2, and one dehumidifying mechanism 3. Alternatively, the air compression device 1 may be provided with two or more electrically-driven air compression mechanisms 2, or may be provided with two or more dehumidifying mechanisms 3.

In the embodiment, the electromagnetic valve 52 is used as the opening/closing mechanism 52. Alternatively, an opening/closing mechanism (e.g. a motor-operated valve) other than the electromagnetic valve 52 may be used as the opening/closing mechanism 52, as far as it is possible to release a part or all of the compressed air remaining in the discharge flow channel 11, the coolers 23, and the dehumidifiers 31 and 32 to the outside when a release operation is performed, and to prevent release of compressed air flowing through the discharge flow channel 11, the coolers 23, and the dehumidifiers 31 and 32 to the outside when an ordinary operation is performed.

In the embodiment, one end (an upstream end) of the release flow channel 13 is connected to the return port 51C formed in the case 53 of the check valve 51. Alternatively, one end (an upstream end) of the release flow channel 13 may be connected to a portion between the check valve 51 and the compressor 21. For instance, one end (an upstream end) of the release flow channel 13 may be connected to the discharge flow channel 11, or may be connected to the dehumidifiers 31 and 32.

The type of the drain valve 36, the method for opening and closing the drain valve 36, the position of the opening/closing mechanism 52 (the electromagnetic valve 52), and the portion to which one end of the release flow channel 13 is connected a-re not specifically limited, as far as it is possible to discharge the remaining compressed air when the compressor 21 is stopped.

In the embodiment, there is employed a mechanism for operating the drain valve 36, with use of an air pressure as a pilot command signal through the opening/closing mechanism 52 (the electromagnetic valve 52). Alternatively, it is possible to directly release the remaining compressed air to the outside through the opening/closing mechanism 52 (the electromagnetic valve 52) when the release amount from the opening/closing mechanism 52 (the electromagnetic valve 52) is large.

In the embodiment, a lapse of time T from the time when a release operation is started is used as the condition for finishing a release operation. Alternatively, for instance, an air pressure in the discharge flow channel 11 may be used as the condition for finishing a release operation. In this case, a pressure sensor for detecting an air pressure in the discharge flow channel 11 is provided. Further, it is determined that a release operation is finished when the pressure value to be detected by the pressure sensor is smaller than a predetermined value.

In the embodiment, a scroll compressor is used as the rotary compressor. The rotary compressor is not limited to a scroll compressor. Other compressor such as a screw compressor may be used as the rotary compressor.

The following is a summary of the embodiment.

An air compression device according to the embodiment is provided with a rotary compressor; a discharge flow channel connected to a discharge portion of the compressor; a release flow channel disposed to be connectable to the discharge flow channel; and an operation control unit configured to perform a release operation of releasing a part or all of compressed air remaining in the discharge flow channel through the release flow channel when the operation control unit controls to stop the compressor.

According to the aforementioned configuration, when the operation control unit controls to stop the compressor, a release operation of releasing a part or all of the compressed air remaining in the discharge flow channel to the outside is performed. Therefore, it is possible to prevent backflow of compressed air toward the compressor after the compressor is stopped, regardless of the absence of an expensive high temperature oriented check valve near the compressor. This is advantageous in preventing the drawbacks such as generation of abnormal sound resulting from backflow.

Specifically, when the release operation is performed, the operation control unit may control to start releasing the compressed air while driving the compressor, and may control to stop the compressor after a predetermined time elapses.

According to the aforementioned configuration, the predetermined time may be a time capable of releasing the compressed air remaining in the discharge flow channel to such an extent that enables to prevent the drawbacks resulting from backflow. It is possible to determine the predetermined time based on an experiment, simulation, or the like. Therefore, the aforementioned configuration is advantageous in securely preventing backflow of compressed air toward the compressor after the compressor is stopped. Further, according to the aforementioned configuration, when a release operation is performed, releasing the compressed air is started while rotating the compressor, and the compressor is continued to be operated until the compressed air remaining in the discharge flow channel is released for a predetermined time. This is advantageous in preventing backflow of compressed air toward the compressor when the compressed air is released to the outside.

When the release operation is performed, the operation control unit may control to start releasing the compressed air while driving the compressor, and may control to stop the compressor when a condition for finishing the release operation is satisfied.

According to the aforementioned configuration, the compressor is continued to be driven until the condition for finishing the release operation is satisfied. This is advantageous in preventing backflow of compressed air toward the compressor when the compressed air is released.

Preferably, the air compression device may be further provided with an opening/closing mechanism which connects or disconnects the discharge flow channel to or from the release flow channel, wherein the operation control unit is configured to bring the opening/closing mechanism to a disconnected state when an ordinary operation of generating compressed air is performed, and to bring the opening/closing mechanism to a connected state before the compressor is stopped when the release operation is performed.

According to the aforementioned configuration, the operation control unit can appropriately perform an ordinary operation and a release operation by controlling the timing of operating the compressor and the timing of stopping the compressor in association with the operations of opening and closing the opening/closing mechanism.

Preferably, the air compression device may be further provided with a silencer which the compressed air to be released passes through when the release operation is performed.

According to the aforementioned configuration, it is possible to reduce the noise generated when compressed air is released during a release operation, when the operation control unit controls to prevent backward rotation of the rotary compressor such as a scroll compressor.

According to the embodiment, in an air compression device provided with a rotary compressor, it is possible to prevent backflow of compressed air toward the compressor after the compressor is stopped regardless of the absence of an expensive high temperature oriented check valve in the discharge flow channel.

This application is based on Japanese Patent Application No. 2014-138111 filed on Jul. 3, 2014, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An air compression device, comprising:

a rotary compressor;

a motor for driving the compressor;

a discharge flow channel connected to a discharge portion of the compressor;

a release flow channel connected with the discharge flow channel and opening to an outside;

a check valve connected such that the discharge flow channel is positioned on an upstream side of the check valve, and the release flow channel and an air tank configured to store compressed air generated by the rotary compressor are positioned on a downstream side of the check valve;

an opening/closing mechanism configured to connect or disconnect the discharge flow channel to or from the release flow channel via the check valve so as to open or close the release flow channel; and an operation controller configured (a) to perform a release operation of releasing a part or all of compressed air remaining in the discharge flow channel to outside of the air compression device during stoppage of the compressor and (b) to perform an ordinary operation of generating the compressed air and storing the compressed air in the air tank, wherein the operation controller is configured to perform the ordinary operation of generating the compressed air and storing the compressed air in the air tank by closing the opening/closing mechanism and closing the release flow channel such that the compressed air generated by the rotary compressor flows through the discharge flow channel and through the check valve to be stored in the air tank, wherein the operation controller is configured to start the release operation releasing the compressed air in the discharge flow channel, through the check valve and through the release flow channel, to outside of the air compression device by opening the opening/closing mechanism while the compressor is driving to compress air, and wherein the operation controller is configured to stop the motor driving the compressor when a condition for finishing the release operation is satisfied in a state where the opening/closing mechanism is opened, the condition being set as a condition indicating a pressure drop of the compressed air in the discharge flow channel for preventing backflow from the discharge flow channel to the discharge portion of the compressor after stoppage of the compressor.

2. The air compression device according to claim 1, wherein, when the release operation is performed, the operation controller controls to start releasing the compressed air in the discharge flow channel, through the check valve and through the release flow channel, to outside of the air compression device while driving the compressor to compress air, and controls to stop the compressor after a predetermined time elapses, the time being set as the condition for finishing the release operation.

3. The air compression device according to claim 1, wherein the operation controller is configured to bring the opening/closing mechanism to a disconnected state when the ordinary operation of generating the compressed air is performed, and to bring the opening/closing mechanism to a connected state before the compressor is stopped when the release operation is performed.

4. The air compression device according to claim 1, further comprising: a silencer which the compressed air to be released passes through when the release operation is performed.

5. The air compression device according to claim 1, wherein the discharge flow channel includes an upstream end connected to the discharge portion of the compressor and a downstream end, wherein the release flow channel includes an upstream end connected with the discharge flow channel and a downstream end having the opening to the outside, and wherein the check valve includes an inlet port connected to the downstream end of the discharge flow channel, an outlet port connected to the air tank, and a return port connected to the upstream end of the release flow channel.

6. An air compression device, comprising:

a rotary compressor;

a motor for driving the compressor;

a discharge flow channel connected to a discharge portion of the compressor;

a release flow channel disposed to be connectable to the discharge flow channel, the release flow being communicated outside the air compression device;

a check valve connected such that the discharge flow channel is positioned on an upstream side of the check valve, and the release flow channel and an air tank configured to store compressed air generated by the rotary compressor are positioned on a downstream side of the check valve;

a valve that connects or disconnects the discharge flow channel to or from the release flow channel via the check valve so as to open or close the release flow channel; and an operation controller configured to perform a release operation by switching the valve to a connected state to release a part or all of compressed air remaining in the discharge flow channel to outside of the air compression device during stoppage of the compressor and to perform an ordinary operation of generating the compressed air and storing the compressed air in the air tank, wherein the operation controller is configured to bring the valve to a disconnected state when an ordinary operation of generating compressed air is performed such that the compressed air generated by the rotary compressor flows through the discharge flow channel and through the check valve to be stored in the air tank, and to bring the valve to the connected state to perform the release operation releasing the compressed air in the discharge flow channel, through the check valve and through the release flow channel, to outside of the air compression device by opening the valve while the compressor is driven to compress air, and wherein the operation controller is configured to stop the motor driving the compressor when a condition for finishing the release operation is satisfied in a state where the valve is opened, the condition being set as a condition indicating a pressure drop of the compressed air in the discharge flow channel for preventing backflow from the discharge flow channel to the discharge portion of the compressor after stoppage of the compressor.

* * * * *